US005695060A

United States Patent [19]

Umiker

[11] Patent Number: 5,695,060

[45] Date of Patent: Dec. 9, 1997

[54] TRAY FOR RECEIVING CONTAINERS, IN PARTICULAR YOGURT CUPS

[75] Inventor: Hans Umiker, Egg, Switzerland

[73] Assignee: Schoeller-Plast SA, Germany

[21] Appl. No.: 804,952

[22] Filed: Feb. 24, 1997

Related U.S. Application Data

[63] Continuation of Ser. No. 411,740, filed as PCT/EP94/02197 published as WO95/05982 Mar. 2, 1995, abandoned.

[30] Foreign Application Priority Data

Aug. 25, 1993 [DE] Germany ..... 43 28 585.6
Sep. 24, 1993 [DE] Germany ..... 43 32 623.4

[51] Int. Cl.[6] ..... B65D 1/36

[52] U.S. Cl. ..... 206/433; 206/560; 206/565; 220/507

[58] Field of Search ..... 206/427, 203, 206/557, 560, 565, 564, 433; 220/507, 514, 518

[56] References Cited

U.S. PATENT DOCUMENTS

| | | | |
|---|---|---|---|
| 2,818,166 | 12/1957 | Hill | 206/560 X |
| 2,879,886 | 3/1959 | Crane | 206/565 X |
| 3,151,761 | 10/1964 | Cloyd et al. . | |
| 4,353,465 | 10/1982 | Rado | 206/565 X |
| 5,022,183 | 6/1991 | Bohlmann | 206/565 X |

FOREIGN PATENT DOCUMENTS

| | | |
|---|---|---|
| 0 114 392 | 8/1984 | European Pat. Off. . |
| 0 361 097 | 4/1990 | European Pat. Off. . |
| 2097990 | 3/1972 | France . |
| 2117934 | 7/1972 | France . |
| 17 88 376 | 1/1959 | Germany . |
| 7103596 | 6/1971 | Germany . |
| 79 19 123 U1 | 4/1979 | Germany . |
| 33 00 590 A1 | 7/1984 | Germany . |
| 38 01 224 A1 | 4/1989 | Germany . |
| 38 06 924 A1 | 9/1989 | Germany . |
| 91 05 553 U1 | 5/1991 | Germany . |
| 40 20 919 A1 | 1/1992 | Germany . |
| 92 04 196.5 | 3/1992 | Germany . |
| 41 41 558 A1 | 10/1992 | Germany . |
| 37 39 547 C2 | 3/1993 | Germany . |
| 4213396 | 10/1993 | Germany . |
| 43 15 487 A1 | 3/1994 | Germany . |
| 651 266 A5 | 9/1985 | Switzerland . |
| 412075 | 8/1974 | U.S.S.R. . |

*Primary Examiner*—Jacob K. Ackun
*Attorney, Agent, or Firm*—VanOphem Meehan & VanOphem, P.C.

[57] ABSTRACT

In a tray for receiving containers, in particular yogurt cups, flexible tongues of compartments are formed for effective engagement of their front free ends with a lower portion of a container resting on the tray bottom. The flexible tongues are shaped like a pitched roof and the inside roof side of each flexible tongue on the compartment side is drawn a corresponding distance toward the tray bottom for effective engagement with the lower container portion.

9 Claims, 4 Drawing Sheets

TRAY FOR RECEIVING CONTAINERS, IN PARTICULAR YOGURT CUPS

This is a continuation of application Ser. No. 08/411,740, filed as PCT/EP94/02197 Jul. 5, 1994 published as WO95/05982 Mar. 2, 1995, and now abandoned.

BACKGROUND OF THE INVENTION

1. Field of the Invention

The present invention relates to a tray or carrier for receiving containers, in particular yogurt cups.

2. Description of the Prior Art

To supply trade with yogurt cups one normally uses so-called trays produced from folding cardboard which are usually able to receive up to twenty yogurt cups. These folding cardboard trays usually have a cardboard bottom, with an intermediate cardboard plate placed thereon and supported by cardboard bars, which is equipped with circular openings in accordance with the number of yogurt cups to be received for holding the yogurt cups inserted in the tray. For transportation purposes, the cardboard tray is usually provided, after being filled with the yogurt cups, with an outer packaging constituted by a shrink film that must be torn off at the place of sale so that the yogurt cups can be transferred from the folding cardboard to the shelves.

Since there are no standard sizes for yogurt cups, a great number of yogurt cups with completely different heights and diameters are available on the market. Since conventional cardboard trays are designed to receive certain cup sizes, they can only receive yogurt cups with a predetermined size. This is extremely disadvantageous because different cardboard trays must be produced and put on the market for each different type of yogurt cup and thus for each yogurt manufacturer. Apart from these disadvantages of the conventional cardboard tray with its outer package, there is a further disadvantage involving the disposal of the package itself. The cardboard trays are generally one-way packages and, therefore, both the outer package and the cardboard tray itself must be disposed of after being supplied to the trade, which entails corresponding effort.

For this reason such cardboard trays have sometimes been replaced by returnable plastic packages. It is known to produce a plastic tray by injection molding which has a bottom for receiving the yogurt cups from which flexible tongues protrude upwardly to define individual receiving compartments for the yogurt cups. These upwardly extending flexible tongues hold the cups in the compartments. Due to the flexible formation of the tongues, the tray can also house yogurt cups with different size dimensions. A disadvantage of these trays is the fact that the upwardly extending flexible tongues grip and hold the yogurt cups in their middle portions or upper portions, which can lead to difficulties when these trays are filled by machine. Also, it has turned out that these flexible tongues cannot receive the enormous range of differently sized yogurt cups. There are currently yogurt cups available on the market whose diameter in the bottom area extends from about 45 mm to 57 mm and whose diameter at a height of 50 mm above the cup bottom ranges from 53 to 67 mm. This range cannot be covered by currently known plastic trays. Also, heretofore known returnable plastic trays do not sufficiently secure the yogurt cups from falling out during transport, e.g. upon a sudden stop of the transport vehicle, whereby the resulting tilt of the containers can make the yogurt cups slide out of the trays.

SUMMARY OF THE INVENTION

The invention is based on the problem of permitting containers, in particular yogurt cups, with a great range of diameters to be received perfectly with respect to handling and the storage and transport function of the tray, while maintaining the returnable function of the tray. A further aspect is to ensure that cups with different diameters reach the tray bottom and rest on the bottom whether inserted in the tray manually or by machine.

In accordance with the invention, the flexible tongues are shaped so that with their front free ends they elastically engage and secure the yogurt cup resting on the tray bottom in the tray at the lower cup portion, i.e. in the manner of an isosceles triangle with an acute angle, whereby the inside roof sides of the flexible tongues facing the compartment and thus the inserted yogurt cup are guided down substantially to the tray bottom with this rooflike, substantially isosceles formation of the flexible tongues. This causes the lower or front free ends of the inside roof sides to engage the yogurt cup at its lower portion. This permits very reliable insertion of yogurt cups into the tray by machine as well as facilitates their removal. The rooflike formation also results in a very great spring excursion in the area of the tray bottom which permits cups with different diameters to be received and simultaneously held reliably in the compartments without preventing the yogurt cups from resting on the tray bottom. The spring contact acts substantially over the total height of the flexible tongue due to restoration of the roof side of the flexible tongue deflected toward the back upon insertion of the yogurt cups, thereby ensuring a reliable and thus also tilt-resistant hold of the yogurt cups. If there is torque action on the yogurt cups which go onto a slant due to excessive impact stress, for example because of an abrupt stop, during transport of these yogurt trays, the restoring force of the flexible tongues which is already built up in the bottom area effectively prevents the yogurt cups from falling out of the tray. It has turned out that a good, tilt-resistant hold of the yogurt cups is obtained if the cups received in the tray are gripped and centered over the circumference of the cup by four tongues that are preferably offset 90° from one another over the cup circumference.

The ribbing on the underside of the tray bottom in the intermediate area between adjacent compartments of the tray, which is necessary with conventional returnable trays for the stacking compound of loaded trays, and which can lead to damage to the yogurt cups, in particular the lids of the yogurt cups, by contact with the ribbing upon removal of the top tray, is replaced according to the invention by beadlike depressions provided in the tray bottom which protrude downward and between which the upper parts of the yogurt cups of the lower tray layer engage. It is expedient to adapt the beads in the area of the holding surface opposite the yogurt cups to the shape of the yogurt cups, in particular to shape them as circular segments. For the purpose of reliable, perfect and stable stacking for the return transport of empty trays, a stack shoulder is provided according to the invention on the side walls of the tray. This stack shoulder also prevents empty stacked trays from nesting too firmly. In this connection, it is expedient to make the upper portions of the side walls above the stack shoulder vertical and thus perpendicular to the plane of the tray bottom, which permits reliable manual gripping of the trays. For the purpose of stacking the portion of the side wall situated below the stack shoulder can taper inwardly.

In order to stiffen the trays it is expedient to equip in particular the narrow end walls of the tray with a profiled edge strip, in particular with a reverse U section, whereby the profile strip can be used as a handle. Gripping by machine is further simplified in that openings are provided in the profile bar. Finally, securing tongues are provided in the lower area of the side walls, primarily in the corner areas, which extend from the top to the bottom and outwardly and can be formed integrally with the tray. This permits hoops and other fastening means to be held so that they cannot slip off the tray. Since cleaning is necessary after each return transport of such returnable containers, it is deemed expedient according to the invention to provide suitable discharge openings in the tray bottom, which furthermore involve a weight saving for the trays. It is expedient to provide such openings in the area below the flexible tongues, which at the same time ensure proper functioning of the flexible tongues and also permit removal of cleaning water. Furthermore, it is expedient to provide openings in the middle of the compartments as well. These openings are preferably circular or have circular corners so as to prevent damage to the yogurt cups during transport or upon removal of trays from a stack.

Further objects, features, and advantages of the invention will become more apparent from the following detailed description of the preferred embodiment thereof when taken in conjunction with the accompanying drawings.

DETAILED DESCRIPTION OF THE PREFERRED EMBODIMENT

Figure 1:
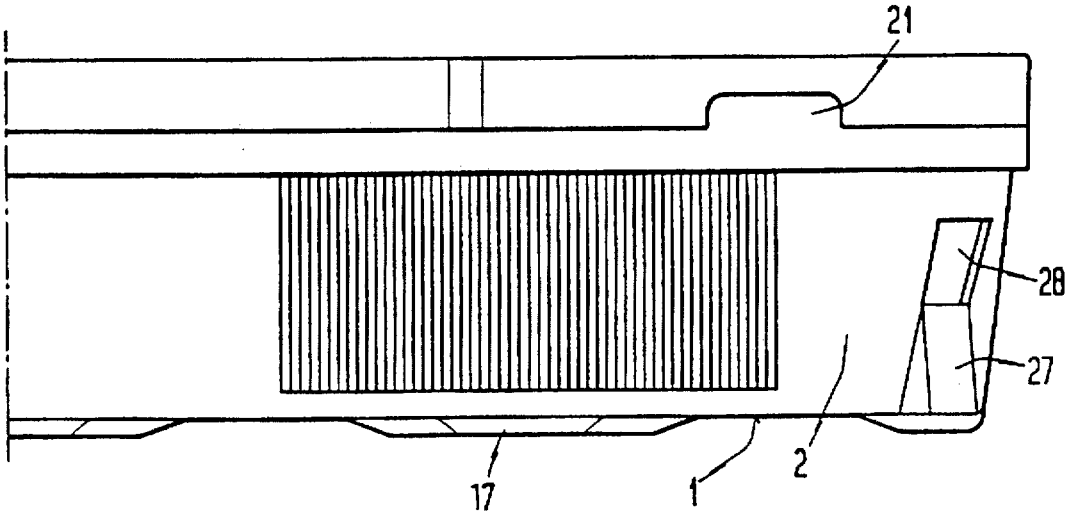
FIG. 1 shows a view of the narrow side of a yogurt tray, only one half of which is shown.
Figure 2:
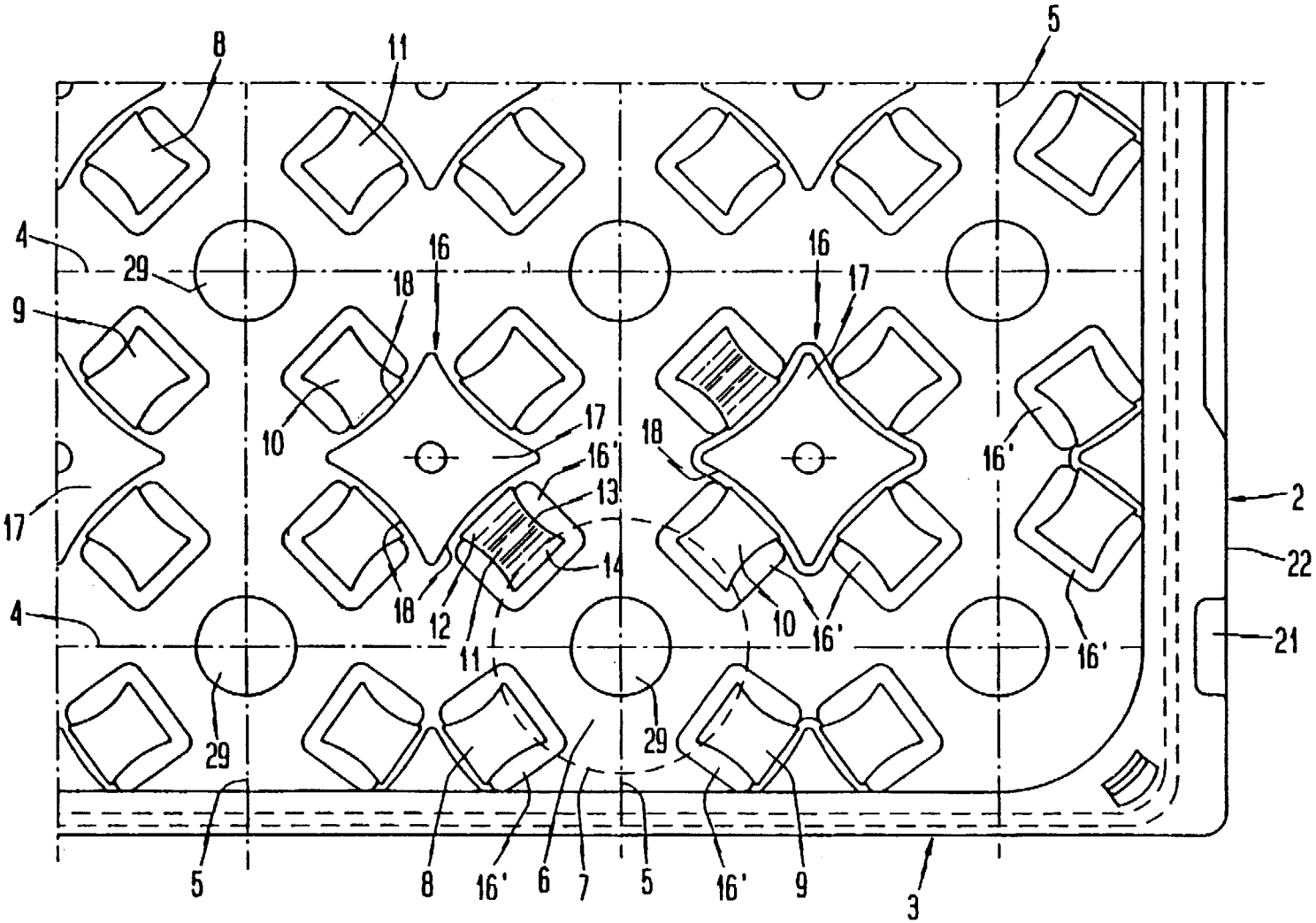
FIG. 2 is a view from above of the yogurt tray shown in FIG. 1, whereby again only part, namely a corner portion, of the tray is shown.
Figure 3:
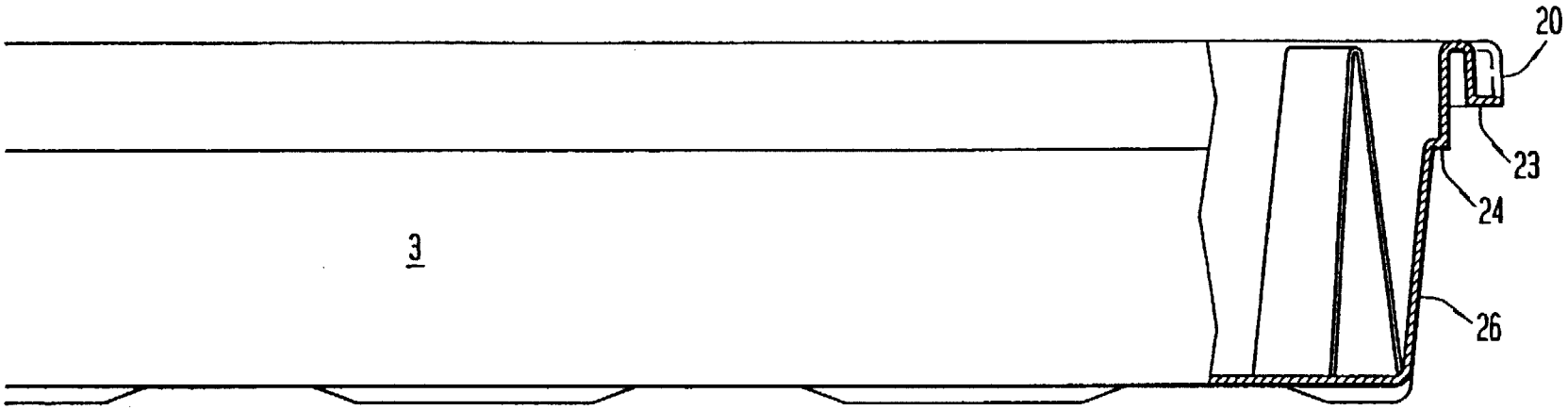
FIG. 3 shows a partly sectional side view of the yogurt tray of FIG. 2.

The tray shown in the figures, which serves to receive yogurt cups, has a bottom designated in general as 1 having a rectangular plan form in the embodiment example shown, and four side walls running around the edge of the bottom, of which a narrow side wall 2 is apparent in FIG. 1 and a longitudinal side wall 3 from FIG. 3. Obviously, the two narrow side walls and the two longitudinal side walls are disposed opposite each other to form the box-shaped tray. In the embodiment example shown the tray serves only by way of example to receive 20 yogurt cups, five cups each in four longitudinal rows 4 parallel to the longitudinal side wall 3 and four cups each perpendicular thereto in five transverse rows 5 parallel to the narrow side wall 2 in twenty compartments 6. The circumference of a yogurt cup received in the tray is shown schematically by a broken line at 7 in FIG. 2. Instead of a tray of twenty, however, the trays can also be designed to receive a different number of yogurt cups, e.g. as trays of twelve.

Figure 4:
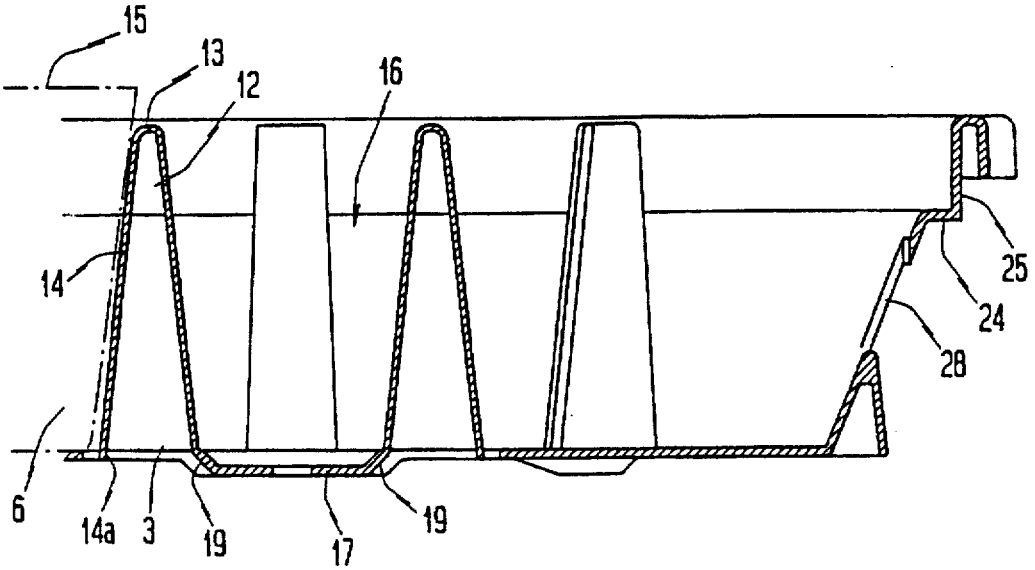
FIG. 4 shows a further sectional view of the yogurt tray, the section being situated parallel to the longitudinal side of the yogurt tray, the tray again only being partially shown.

To receive the yogurt cups in the tray, several flexible tongues are provided per compartment 6, in the embodiment example shown four flexible tongues 8, 9, 10 and 11 per compartment 6, the flexible tongues being disposed opposite each other in pairs. As seen best from FIGS. 4 and 5, the flexible tongues have a rooflike form in cross section, whereby a roof side 12 facing away from the compartment 6 extends from the tray bottom upward to a ridge 13, and the roof side designated as 14 pointing to the interior of the compartment extends from the ridge 13 to the tray bottom 1. To better show how a yogurt cup is received in the tray, FIG. 4 shows a yogurt cup 15 schematically by dash-dot lines. One can see four rooflike flexible tongues 8 to 11 with their roof sides 12 on the outside with respect to the compartment connected to the tray bottom, whereas the inside roof sides 14 are free at their bottom ends **14*a*, as shown. For this purpose corresponding openings 16' are formed on the tray bottom below each flexible tongue. One can see in the embodiment example shown how the roof side 14 extends with its front end into an opening 16' in the tray bottom 1. For the sake of better illustration, only the flexible tongue 11 is provided with reference numbers 12 to 14 in FIG. 2 to represent the roof sides and the ridge, all the other flexible tongues being of analogous design. If a yogurt cup is inserted in the compartment 6 from above, a great range of cup diameters can be received due to the very wide spring excursion resulting from the great bottom distance between the two roof sides 12 and 14. Depending on the diameter size of the cup, the roof sides 12 and 14 are urged outward a corresponding distance and then hold the received cup within the compartment 6 due to the built-up initial spring tension. It is also easy to remove the yogurt cups. The lower portions of the inside roof sides engage the yogurt cup at its lower portion, which is not indicated by the strictly schematic representation in FIG. 4** intended only to illustrate the arrangement of a cup within a compartment.

Also, as best indicated by FIG. 4, beads 17 are formed in the intermediate areas between adjacent compartments 6 designated as 16 in FIGS. 4 and 2, the beads thus being disposed between outside roof sides 12 (relative to the compartment side) of adjacent flexible tongues. The beads 17 protrude downward from the tray bottom and serve to hold loaded trays in a stack, the yogurt cups of the lower tray engaging between beads 17 of the tray thereabove. For this purpose the beads 17 are formed with holding surfaces 18 adapted to the cup shape, being shaped as circular segments in the embodiment example shown. The beads 17 are connected to the tray bottom 1 via slanting surfaces 19, although rounded surfaces are also conceivable. Otherwise, the tray bottom is smooth and plane on the top and underside. The beads ensure very good stackability of loaded trays and very easy removal of trays from the stack, without any damage to the yogurt cups or their lids in the tray below.

The upper edge of each narrow side 2 of the tray is formed by an edge strip 20 with a U-shaped downwardly directed cross section, the U section being indicated by FIG. 3. The U section extends over the entire narrow side of the tray. To permit machine handling in the empty state and in the loaded state of stacked trays, openings 21 are provided according to FIGS. 1 and 2 in the area of the edge strip 20 on the narrow side of each tray, one opening being provided to the left and right near the corners. A machine gripper can be moved in through the opening 21 in the outside web of the edge profile strip 20 to raise the trays. Finally, as best indicated by FIG. 2 in the area of the narrow side 2, an outer web 22 of the edge profile strip 20 is shifted inwardly in the area of the middle of the narrow side 2, resulting in better gripping of the trays. A horizontally outwardly extending crossbar 23 can be provided at the lower end of the web 22. However, this crossbar can also be omitted as in FIG. 5.

Figure 6:
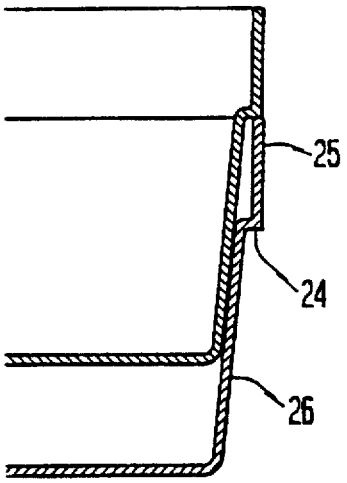
FIG. 6 shows a partial sectional view of two stacked yogurt trays in a strictly schematic representation, whereby the section is drawn perpendicular to FIG. 5.
Figure 5:
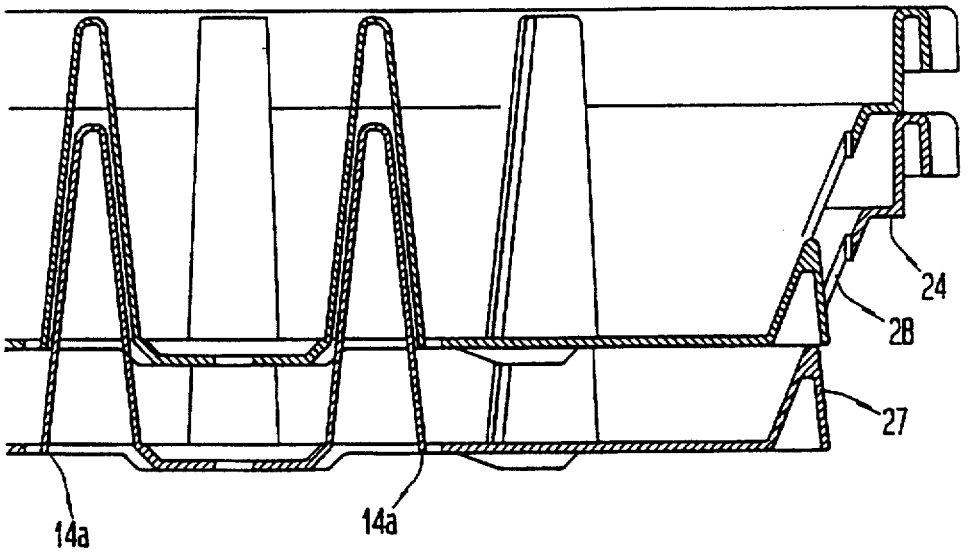
FIG. 5 shows sectional views, according to FIG. 4, of two stacked yogurt trays.

Extending around the four side walls, an inwardly shifted stack shoulder 24 is also provided via which the trays are placed one upon the other in the stacked position, as indicated best by FIGS. 5 and 6. A wall portion 25 above the stack shoulder 24 is preferably vertical, i.e. perpendicular to the plane of the tray bottom 1, which permits reliable gripping by machine without the grippers slipping off. The lower wall portion designated as 26, on the other hand, tapers inwardly from the top to the bottom for purposes of stackability. In the corner areas the tray also has a securing device for receiving known hoops and the like, as are used for holding stacked trays together on pallets. The securing device is constituted by downwardly outwardly directed tongues 27 in the lower wall portion 26 which prevent a hoop, elastic band and the like from slipping off. The securing tongues 27 are each disposed on one corner side in the embodiment example shown, so that two securing tongues 27 are provided in the corner area per side wall. The securing tongues 27 can be formed integrally with the tray. Openings 28 are preferably formed in the side walls above the securing tongues 27.

Finally, in addition to the openings 16, openings 29 are provided in the tray bottom to remove cleaning water. It is expedient for the openings 29 and openings 16' to each be formed with rounded corners to avoid any damage to the yogurt cups. In the embodiment example shown, the discharge openings 29 are circular.

While the invention has been described in terms of a preferred embodiment, it is apparent that other forms could be adopted by one skilled in the art. Accordingly, the scope of the invention is to be limited only by the following claims.

What is claimed is:

1. A tray for receiving containers, said tray comprising:

a bottom having a compartment for receiving a container; and a plurality of flexible tongues located about said compartment, each flexible tongue of said plurality of flexible tongues having a first surface fixed to said bottom of said tray and extending upward from said bottom to a predetermined height, each flexible tongue of said plurality of flexible tongues having a second surface having a free end, said second surface extending downward from said predetermined height such that said free end of said second surface is aligned with said bottom of said tray, said second surface continuous between said predetermined height and said free end of said second surface, said second surface for flexing with respect to said first surface and engaging a lower portion of a container inserted in said compartment.

2. The tray of claim 1 wherein said plurality of flexible tongues further comprises four flexible tongues surrounding said compartment said four flexible tongues being disposed diametrically opposite each other in pairs.

3. The tray of claim 1 wherein said tray further comprises a pattern depressed into said bottom, said pattern being formed as circular segments in a plan view of said tray in conformity with the containers to be received.

4. The tray of claim 1 wherein said bottom further comprises a plurality of side walls surrounding said bottom, said plurality of side walls extending upward to approximately said predetermined height of said plurality of flexible tongues.

5. The tray of claim 4 wherein said plurality of side walls comprise two narrow side walls having an upper edge, said upper edge of each of said narrow side walls formed as a strip having an inverted U section, each said strip extending completely over each of said narrow side walls.

6. The tray of claim 5 wherein each of said two narrow side walls further comprise openings for machine handling.

7. The tray of claim 4 wherein said plurality of side walls comprises an outwardly shifted shoulder for resting on a periphery of a lower tray when stacked.

8. The tray of claim 7 wherein said plurality of side walls further comprises an upper wall portion located above said outwardly shifted shoulder and extending vertically to said bottom; and a lower wall portion located below said outwardly shifted shoulder tapered inward toward said bottom.

9. The tray of claim 4 further comprising a plurality of securing tongues extending outward from said plurality of side walls for securing stacked trays together.

* * * * *